US005106227A

United States Patent [19]

Ahmad et al.

[11] Patent Number: 5,106,227

[45] Date of Patent: * Apr. 21, 1992

[54] REINFORCED ASPHALT CONCRETE AND STRUCTURE FOR PRODUCING SAME

[75] Inventors: Jameel Ahmad; Joseph P. Valenza, both of Queens, N.Y.

[73] Assignee: Hifh Technologies, Inc., Forest Hills, N.Y.

[ * ] Notice: The portion of the term of this patent subsequent to Apr. 23, 2008 has been disclaimed.

[21] Appl. No.: 655,730

[22] Filed: Feb. 14, 1991

Related U.S. Application Data

[63] Continuation of Ser. No. 385,247, Jul. 25, 1989, Pat. No. 5,009,543.

[51] Int. Cl.[5] ..... E01C 11/18

[52] U.S. Cl. ..... 404/70; 404/134

[58] Field of Search ..... 404/70, 134

[56] References Cited

FOREIGN PATENT DOCUMENTS 632486 12/1961 Canada ..... 404/70
284428 4/1931 Italy ..... 404/70
237528 7/1986 Netherlands ..... 404/70

*Primary Examiner*—William P. Neuder
*Attorney, Agent, or Firm*—Cooper & Dunham

[57] ABSTRACT

A reinforcement structur for asphalt pavements comprising corrugated or zig-zag bent perforated or open mesh strips disposed relative to each other so that when said strips are brought into contact with each other and fixed together at the apices the contacting strips define therebetween a plurality of cells or honeycomb-like structure. Further, there is provided a superior asphalt pavement when the above-described reinforcement structure is positioned and embedded within said pavement.

7 Claims, 4 Drawing Sheets

REINFORCED ASPHALT CONCRETE AND STRUCTURE FOR PRODUCING SAME

This is a continuation of application Ser. No. 385,247 filed July 25, 1989, now U.S. Pat. No. 5,009,543 issued Apr. 23, 1991.

BACKGROUND OF THE INVENTION

Asphalt pavements, roads, sidewalks and the like are subject to deterioration such as cracks, cave-ins, and potholes. Such deterioration may occur in the original asphalt surface but is more likely in areas of refilled or repaired asphalt cuts or excavations which often times are repeatedly dug to repair and/or replace the underlying utility network, such as telephone wires, electrical systems or aqueducts.

Past practices have attempted to improve the structural integrity of asphalt pavement by inserting within the pavement a planar construct structure or flat wire mesh of various geometric design.

One such construct is disclosed in U.S. Pat. No. 181,392. This patent discloses a substantially planar structure of single iron rings provided with exterior wedge-shaped projections which are rigidly united or assembled by a connecting strip. U.S. Pat. No. 1,707,939 discloses a reinforced pavement structure which comprises a flat planar mesh structure of expanded metal. U.S. Pat. No. 1,809,870 is of a substantially similar construction in that a flat planar open reinforcement structure comprising a number of bars each bent to include a plurity of substantially V-shaped formations along its length. The bars are arranged with the apex portions of the V-shaped formations in abutting relation with clips bent around the abutting apex portions of said bars to hold the bars in place. The resulting construct is then inserted within concrete as reinforcement for cement.

Other structures to reinforce pavement and the like are disclosed in U.S. Pat. Nos. 2,179,019, 2,184,146, and 4,309,124. The disclosures of these patents neither disclose nor suggest the subject invention.

It is an object of this invention to provide a reinforcing structure for asphalt pavements and the like which may be utilized in the new construction or repair or for rehabilitation/resurfacing of existing asphalt pavements. It also may be utilized in the resurfacing asphalt layer.

It is another object of this invention to provide material and techniques for repairing asphalt roads.

It is a further object of this invention to lessen or eliminate dependence on optimum compaction of backfill material in asphalt pavement repair.

How these and other objects of this invention are achieved will be apparent from the following disclosure made with reference to the accompanying drawings wherein:

FIG. 3 is a vertical cross-sectional view of a road repair in accordance with this invention, and wherein;

SUMMARY OF THE INVENTION

This invention provides a reinforcement structure which comprises a plurality of perforated, corrugated or bent mesh strips disposed, connected and fixed to each other at a plurality of points so as to form a structure having a plurality of discrete or separate cells or spaces defined by said connected strip.

This invention also provides an asphalt pavement comprising an asphalt concrete layer and the above-described open mesh reinforcement structure laid or incorporated therein.

DETAILED DESCRIPTION OF THE INVENTION

Figure 1:
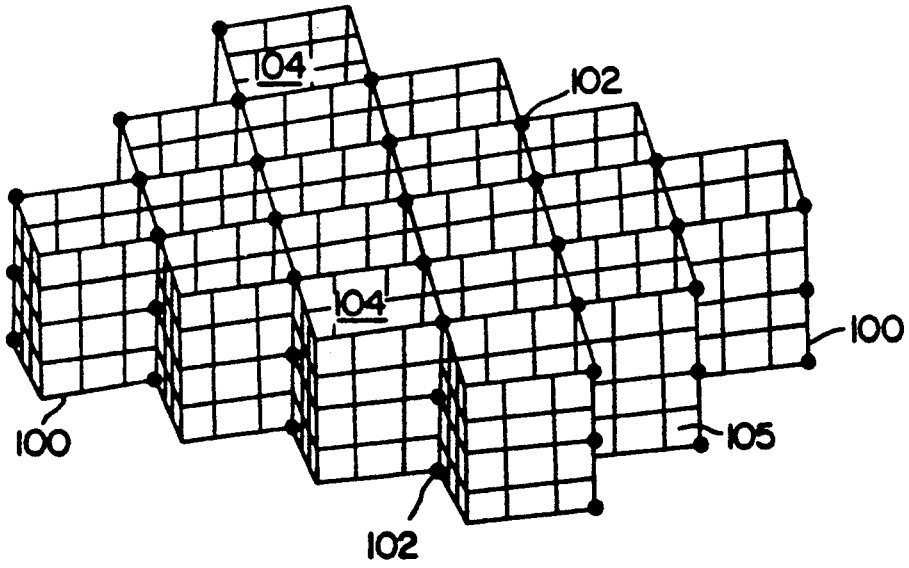
FIG. 1 is a perspective planar view of an asphalt concrete reinforcing construct in accordance with this invention.

FIG. 1 illustrates an open mesh reinforcement structure of this invention. In FIG. 1, the open mesh reinforcement structure comprises a plurality of bent, corrugated or convoluted open mesh strips or walls 100 welded, joined or connected at a plurality of points or locations 102 where strips 100 abut or contact to form a structure having open cells 104 to provide a honeycomb-like structure.

The strips or walls of the constuct of the present invention may be manufactured from any material which has sufficient load-deflection strength and failure behavior so that the construct of this invention made therefrom, when employed as a road surface reinforcing material, can resist compression loads without complete collapse and thereby serve as a pavement reinforcement. Such materials comprise but are not limited to steel, stainless steel, galvanized steel, aluminum, other metals, ferous and non-ferrous, and structural plastics.

Wire when employed to fabricate the structure of this invention may have a diameter from about 0.01 inch to about 0.2 inch, however, wire having a diameter from about 0.025 inch to about 0.05 inch is preferred.

The openings in the open mesh walls or strips of the structure, when employed to reinforce asphalt, desirably have holes or openings 105 of sufficient size so that when employed as reinforcing, the asphalt concrete can move laterally therethrough. When the reinforced asphalt or asphalt concrete is compacted, the resulting concrete asphalt-mesh reinforcement system creates a stacked plate system that effectively contributes to the compressive strength of the resulting reinforced pavement. The openings of the strips may be of uniform size throughout the mesh structure and may range from about ¼ inch to about 3 inches in diameter or longest dimension, although a size range from about ¼ inch to about 1 inch in diameter or longest dimension is preferred.

Figure 2:
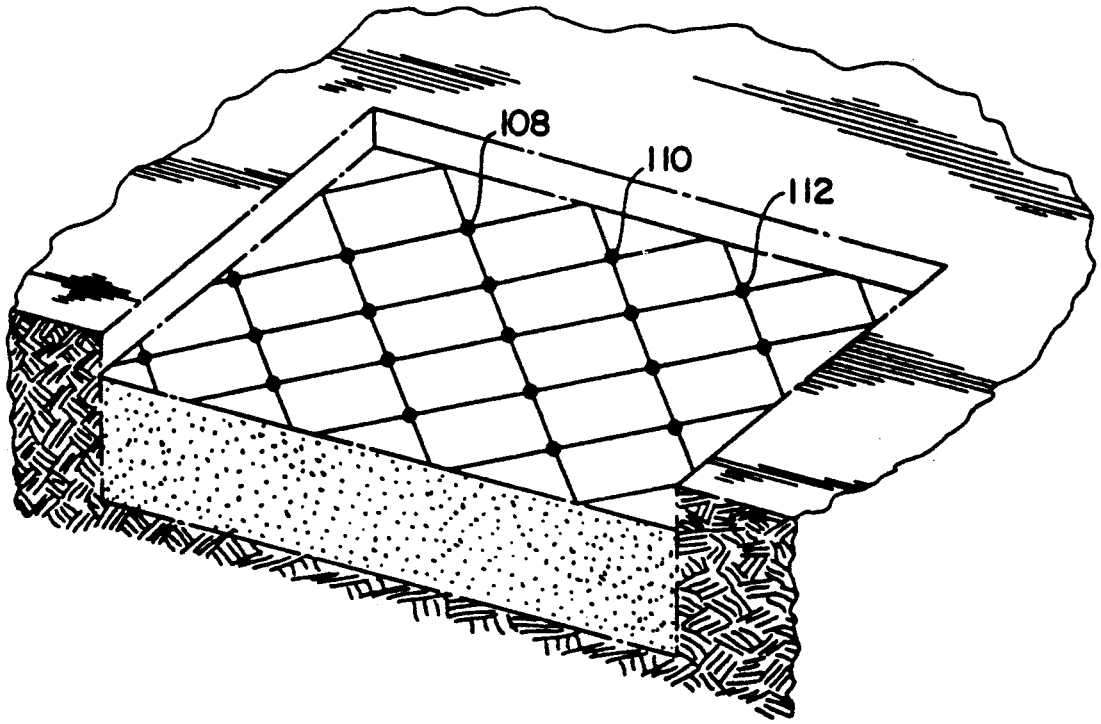
FIG. 2 is a cross-sectional view in perspective of a partially completed road repair employing the reinforcing construct in accordance with this invention.

FIG. 2 shows in perspective vertical cross section an open asphalt-mesh reinforced road repair in accordance with this invention without the top finish coat of asphalt. In FIG. 2, there is shown a plurality of the points or locations on the mesh wall of the construct of this invention, 108, 110, 112, for example. Such points are positioned substantially equidistant along the mesh walls or strips. Each mesh wall of the open honeycomb mesh structure is connected to another mesh wall at an alternate array of points. The mesh wall may be connected or joined by wire ties, such as one tie at the top of the mesh wall, one tie at the bottom of the mesh wall and one tie at the middle of the mesh wall height, or the walls may be otherwised fixed, e.g. by welds, at such points.

The joined open mesh walls create a honeycomb structure or a plurality of vertical receptacles or cells into which the asphalt is placed. When the asphalt has cooled, the cells or receptacles filled with asphalt create column-like support structures which contribute to the overall strength of the reinforced pavement, creating a final structure with superior membrane and bending rigidity.

Figure 3:
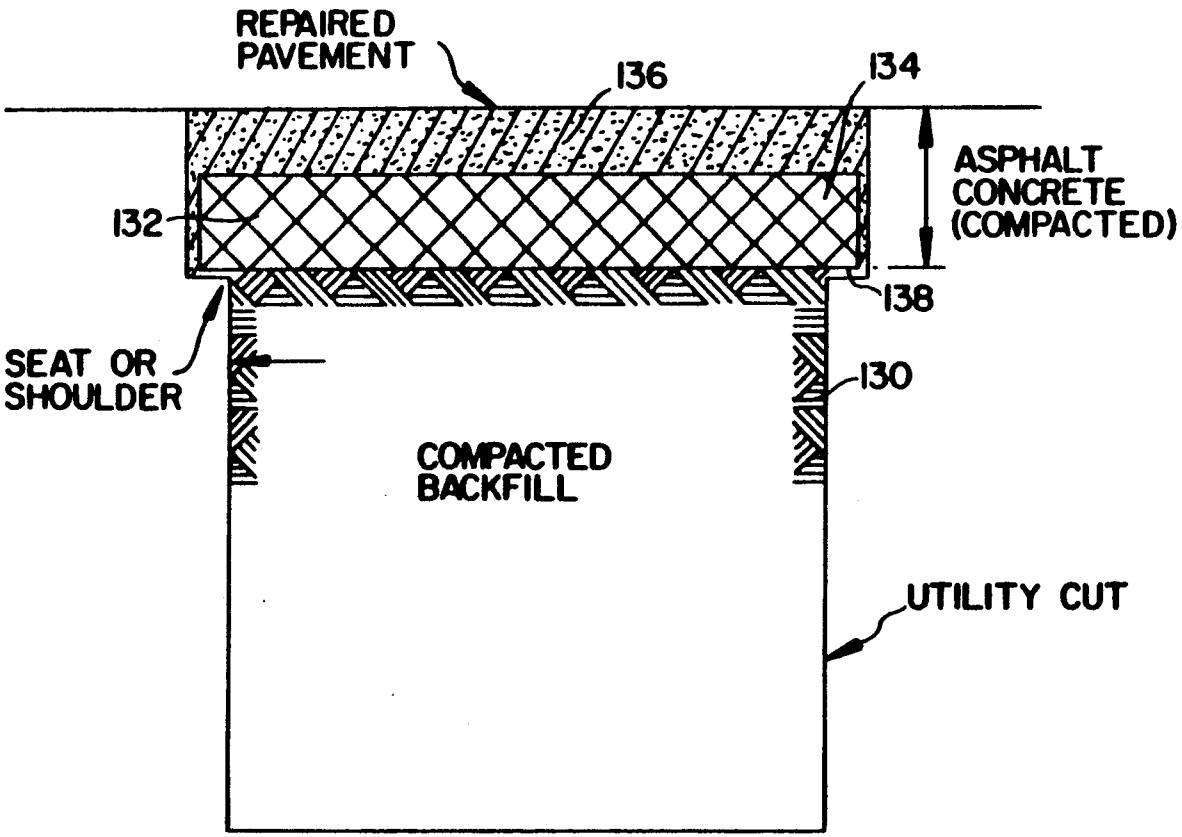

FIG. 3 shows a vertical cross section of a flexible mesh structure inserted into a restructed or repaired pavement. More specifically, FIG. 3 shows a pavement which comprises a suitable base material 130 of compacted backfill and an asphalt concrete layer 132 and the mesh reinforcement structure 134 described hereinabove supported on shoulder or seat edge 138 and laid within the asphalt concrete layer 132. Surface compacted asphalt concrete layer 136 forms the top finish coat and when the asphalt concrete is compacted it fills the cells of the reinforcing structure and moves through the openings of the mesh structure.

Figure 4:
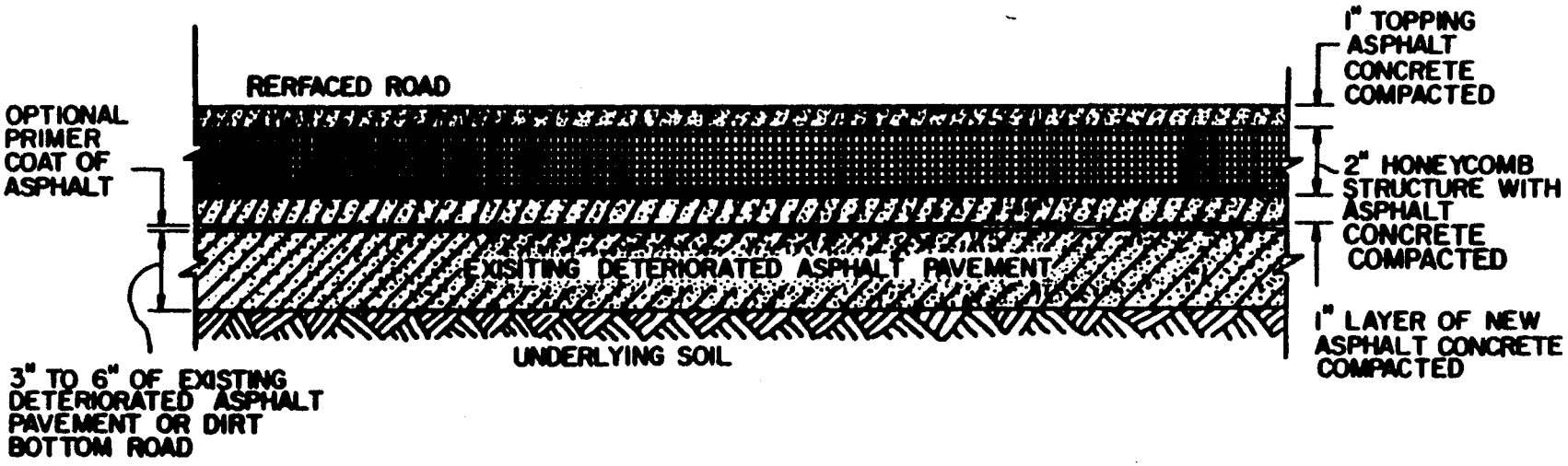
FIG. 4 is a vertical cross section of a repaired or resurfaced asphalt road employing the reinforcement of this invention.

In yet another embodiment, FIG. 4, of this invention, the reinforcement structure described hereinabove is laid upon existing deteriorated asphalt pavement for resurfacing or rehabilitation of dirt-bottom roads with no existing base course. Between said deteriorated pavement and the reinforcement structure, after optionally applying an asphalt primer coat is laid, about one inch, new compacted asphalt concrete on top of the primer coat of asphalt. The reinforcement structure is then laid and asphalt concrete is then poured on top thereof and into the reinforcement structure and compacted. Sufficient asphalt concrete is employed so as to provide a top coat or asphalt at least one inch above the reinforcing structure, as illustrated.

Tests were carried out to demonstrate the advantage of the practice of this invention. In these tests, a reinforcing construct, such as illustrated in FIG. 1, was embedded in an asphalt concrete layer prior to compaction. As the asphalt is compacted, the reinforcement structure experiences a "pancaking" effect and as a result, the asphalt columns filling the cells in the honeycomb-cellular reinforcement structure are laterally connected as the asphalt concrete penetrates the wiremesh openings of the reinforcement structure. The asphalt concrete reinforced with the reinforcement structure thereby acts as a monolithic structural medium with lateral continuity. In addition, the wiremesh reinforcement structure greatly enhances the membrane and bending rigidity of the pavement. This provides and explains the vastly improved strength characteristics of reinforced asphalt.

EXPERIMENTAL

To evaluate the structural strength of the reinforcement structure-asphalt concrete system of this invention a comparative laboratory investigation was carried out.

Over a 5 month period asphalt concrete slabs reinforced with the reinforcement structure were tested in bending and their load-deflection and failure behavior was compared with the behavior of similarly loaded unreinforced asphalt concrete slabs.

Test slabs were constructed by pouring hot mix asphalt in a metal box with internal dimensions of 20"×3". The box was divided into two equal compartments by a vertical center divider. One of the compartments contained a reinforcement structure while the other half was used to pour the unreinforced slab. After filling the box with asphalt concrete, compaction loads were applied through a steel plate measuring 20"×12"×1" which was placed on top of the 3-inch asphalt layer. Compressive loads were applied in a Tinius-Olson hydraulic machine with a capacity of 120,000 lbs. In all tests, both reinforced and unreinforced slabs were compressed to 83% of their original thickness so that the compacted slabs all measured approximately 10"×12"×2.5". After compaction, the specimens were allowed to cool to room temperature.

For the free-span bending tests, the slabs were placed across two simple supports 6 inches apart. Reinforced slabs were placed with the longitudinal rather than transverse orientation with the wiremesh spanning over the supports. To simulate wheel loads to the test sections, loads were applied at the center of the span through a vertical semicircular metal disk 3 inches in diameter and one inch in thickness. Loads were applied gradually and vertical deflections under the load were measured until failure or until a prescribed value of the deflection was reached.

Failure in the unreinforced sections occurred under the load with a vertical crack initially appearing at the bottom of the slab and propagating through the thickness to split the slab completely into two halves. At failure, the maximum deflections were less than ½ inch in all cases.

In slabs reinforced with the structure of the invention, the behavior under load was much more elastic. The cracks appearing initially in the bottom fibers of the slabs did not propagate through the thickness with the increase in load as the reinforcement resisted the load by both bending and membrane action. The slabs never failed by splitting through as in the case of the unreinforced sections even under very heavy loads. "Failure" load for reinforced slabs was defined as that value which produced a deflection of 1-inch under the load. Upon removal of the load, the deflection gradually disappeared and the slab returned to its original configuration. This behavior clearly indicated that the wiremesh reinforcement structure was acting integrally with the asphalt concrete, greatly enhancing its membrane and bending structural stiffness.

Results for one typical series of tests are shown in Table 1. The asphalt reinforcement structure was galvanized steel-2 mesh (wire diameter 0.041 inch; mesh opening ½ inch). The structural cells of the reinforcement structure were 4 inch in length, 2½ inch in height in the collapsed configuration. The seven tests reported in Table 1 produced remarkably consistent results. The reinforcement structure-reinforced slabs were 9 to 13 times stronger than the unreinforced sections based on their failure loads previously defined. In each test, the reinforced and unreinforced slabs were poured from the same hot-mix asphalt, but different tests were conducted in different days and used different asphalts.

TABLE 1

Results of Slab Tests: 6-inch Free-Span Bending
Galvanized Steel-2 Mesh
(0.041" wire diameter; ½ inch mesh opening)

| | Test Temp (°F.) | Load at Failure (lbs) Unreinforced (PU) | Load at Failure (lbs) Reinforced (PR) | Strength Multiplier (PR/PU) |
|---|---|---|---|---|
| 1 | 80–90 | 120 | 1345 | 11.2 |
| 2 | 80–90 | 125 | 1350 | 10.8 |
| 3 | 80–90 | 125 | 1515 | 12.1 |
| 4 | 80–90 | 165 | 1605 | 9.7 |
| 5 | 80–90 | 175 | 1610 | 9.2 |
| 6 | 80–90 | 125 | 1650 | 13.2 |

TABLE 1-continued

Results of Slab Tests: 6-inch Free-Span Bending
Galvanized Steel-2 Mesh
(0.041" wire diameter; ½ inch mesh opening)

| | Test Temp (°F.) | Load at Failure (lbs) Unreinforced (PU) | Reinforced (PR) | Strength Multiplier (PR/PU) |
|---|---|---|---|---|
| 7 | 80–90 | 110 | 1150 | 10.4 |

1. The reinforcement structure cells were 4-inch in length ½ inch in height, in collapsed configuration.
2. Three ties per fastener or welds were used, one at top, one in middle, one at bottom (wire diameter 0.047 inch, if ties).
3. Failure for reinforced slabs was defined as load corresponding to 1" deflection. Upon removal of load, the slab bounced back to original configuration.
4. Upon failure, unreinforced slabs split completely into two halves under load.

As will apparent from the foregoing, many alterations or modifications of the practices of this invention are possible without departing from the spirit or scope thereof.

What is claimed is:

1. A stiff, self-supporting, compressible reinforcement structure which compresses substantially to the same extent as asphalt concrete upon compaction when inserted therein as reinforcement for said asphalt concrete comprising open mesh wire strips, configured and disposed relative to each other such that said strips are in side-by-side contact with each other and fixed together, the fixed contacting wire strips defining a plurality of cells or honeycomb-like strips making up said reinforcement structure.

2. A stiff, self-supporting, compressible reinforcement structure which compresses when inserted as reinforcement within asphalt concrete to the same extent as the asphalt concrete upon compaction of said asphalt concrete, comprising an arrangement of open mesh wire strips defining a plurality of cells or spaces within said arrangement, said cells or spaces of said arrangement being defined by said wire mesh strips which are disposed and configured and fixed together in side-by-side relationship to make-up said reinforcement structure.

3. A reinforcement structure in accordance with claim 1 wherein said wire mesh strips have openings from about ¼" to about 3" in diameter or in length along the longest dimension of said openings within said wire mesh.

4. A reinforcement structure in accordance with claim 1 wherein said open mesh wire strips are made of steel.

5. A reinforcement structure in accordance with claim 1 wherein said open mesh wire strips are made of ferrous metal.

6. A reinforcement structure in accordance with claim 1 wherein said open mesh wire strips are made of non-ferrous metal.

7. A reinforcement structure in accordance with claim 1 wherein said open mesh wire strips comprise plastic.

* * * * *